US012116755B2

(12) United States Patent
Song et al.

(10) Patent No.: US 12,116,755 B2
(45) Date of Patent: Oct. 15, 2024

(54) MACHINE GUIDANCE PROGRAM AND EXCAVATOR USING THE SAME

(71) Applicant: HD HYUNDAI INFRACORE CO., LTD., Incheon (KR)

(72) Inventors: Seong Ho Song, Incheon (KR); Han Sol Kim, Incheon (KR); Yeo Eun Kim, Incheon (KR)

(73) Assignee: HD HYUNDAI INFRACORE CO., LTD., Incheon (KR)

( * ) Notice: Subject to any disclaimer, the term of this patent is extended or adjusted under 35 U.S.C. 154(b) by 297 days.

(21) Appl. No.: 17/679,876

(22) Filed: Feb. 24, 2022

(65) Prior Publication Data

US 2022/0268000 A1 Aug. 25, 2022

(30) Foreign Application Priority Data

Feb. 25, 2021 (KR) ..... 10-2021-0025917

(51) Int. Cl.
*E02F 9/26* (2006.01)
*E02F 3/32* (2006.01)

(52) U.S. Cl.
CPC ..... *E02F 9/264* (2013.01); *E02F 3/32* (2013.01); *E02F 9/261* (2013.01)

(58) Field of Classification Search
CPC ..... E02F 9/264; E02F 3/32; E02F 9/261; E02F 3/435; E02F 3/30; E02F 9/205; E02F 9/26; E02F 9/20; E02F 9/265; G06F 3/04817; G06F 3/0484
USPC ..... 701/1, 50
See application file for complete search history.

(56) References Cited

U.S. PATENT DOCUMENTS 5,854,988 A * 12/1998 Davidson ..... E02F 9/26 701/50
8,903,604 B2 * 12/2014 Fukano ..... E02F 9/264 701/457
8,942,895 B2 * 1/2015 Nomura ..... E02F 9/26 701/50
10,934,688 B2 * 3/2021 Nishi ..... E02F 3/32
10,934,689 B2 * 3/2021 Izumikawa ..... E02F 9/264
(Continued)

FOREIGN PATENT DOCUMENTS

CN 103906879 A 7/2014
CN 106894455 A 6/2017
(Continued)

OTHER PUBLICATIONS

The extended European Search Report dated Jul. 18, 2022 for corresponding European Patent Application No. 22158371.9, 10 pages.

(Continued)

*Primary Examiner* — Jaime Figueroa
(74) *Attorney, Agent, or Firm* — Hauptman Ham, LLP

(57) ABSTRACT

Embodiments of the present disclosure relate to a machine guidance program and an excavator using the same. The machine guidance program which assists an operator of an excavator including a bucket to operate is configured to display a guidance screen on a display device. The guidance screen includes: a front view; a first guide indicator which guides in which tilting direction the operator should operate; a side view; and a second guide indicator which guides whether the operator should operate in a dump direction or in a crowd direction.

20 Claims, 9 Drawing Sheets

(56) References Cited

U.S. PATENT DOCUMENTS

| | | | | |
|---|---|---|---|---|
| 11,142,883 | B2 * | 10/2021 | Izumikawa | E02F 9/2004 |
| 11,168,466 | B2 * | 11/2021 | Izumikawa | E02F 3/32 |
| 11,299,870 | B2 * | 4/2022 | Kumakura | E02F 9/261 |
| 2013/0158797 | A1 * | 6/2013 | Fukano | E02F 9/2025 701/36 |
| 2014/0100712 | A1 * | 4/2014 | Nomura | E02F 9/264 701/1 |
| 2014/0100744 | A1 * | 4/2014 | Johnson | E02F 3/3677 701/50 |
| 2015/0345114 | A1 * | 12/2015 | Nomura | E02F 5/025 37/379 |
| 2016/0010312 | A1 * | 1/2016 | Kurihara | E02F 9/261 701/36 |
| 2018/0051446 | A1 * | 2/2018 | Yoshinada | E02F 9/264 |
| 2019/0024346 | A1 * | 1/2019 | Nishi | E02F 9/264 |
| 2019/0024347 | A1 * | 1/2019 | Izumikawa | E02F 9/264 |
| 2019/0218744 | A1 * | 7/2019 | Izumikawa | E02F 9/264 |
| 2020/0018046 | A1 | 1/2020 | Izumikawa | |
| 2021/0010226 | A1 * | 1/2021 | Tanaka | E02F 9/2033 |
| 2021/0131075 | A1 * | 5/2021 | Kumakura | E02F 9/264 |

FOREIGN PATENT DOCUMENTS

| | | | |
|---|---|---|---|
| CN | 108699815 | A | 10/2018 |
| CN | 108884668 | A | 11/2018 |
| CN | 110300827 | A | 10/2019 |
| CN | 110462143 | A | 11/2019 |
| EP | 3521517 | A1 | 8/2019 |
| IN | 110352281 | A | 10/2019 |
| JP | 2017-186901 | A | 10/2017 |
| KR | 10-1475771 | B1 | 12/2014 |
| KR | 10-2018-0132076 | A | 12/2018 |
| KR | 10-2019-0110590 | A | 9/2019 |
| WO | 2014/054194 | A1 | 4/2014 |
| WO | 2017/170382 | A1 | 10/2017 |

OTHER PUBLICATIONS

Chinese Office Action issued on Mar. 24, 2023 in connection with the Chinese Patent Application No. 202210175372.2, 9 pages.

* cited by examiner

MACHINE GUIDANCE PROGRAM AND EXCAVATOR USING THE SAME

CROSS-REFERENCE TO RELATED APPLICATION

This application claims the benefit under 35 U.S.C. § 119 of Korean Patent Application No. 10-2021-0025917, filed on Feb. 25, 2021, in the Korean Intellectual Property Office, the entire disclosure of which is incorporated herein by reference for all purposes.

BACKGROUND

Field

Various embodiments of the present disclosure relate to a machine guidance program and an excavator using the same.

Description of the Related Art

Construction sites where construction works are carried out using construction machines are increasingly requiring precision work in addition to basic work such as conventional loading, excavation, etc. The precision work may mean work that requires precision within an error range of 2 cm to 3 cm based on the design drawing of the construction site.

In addition, skilled workers with long experience in the construction sites are gradually aging, and research is being conducted to make it easier for unskilled workers to perform work which requires precision.

In accordance with such a trend, construction machine is equipped with a new system or program that can assist unskilled persons, which is called machine guidance (MG), machine control (MC), etc. Various attachments (e.g., a tilt rotator) capable of improving precision are being applied to the construction machine.

There is a variety of important information on precision work, and one of pieces of information on the excavator may be horizontal alignment information between a target surface of a design drawing and a bucket surface. In addition, a machine guidance program provides a guidance to an excavator operator by displaying, on a display device of the construction machine, information on whether the target surface of a design drawing and the bucket surface are horizontally aligned or not. For example, Korean Patent Application Laid-Open No. 10-2019-0110590 proposes a facing compass which is a guidance mark for aligning the line of the blade tip LBT of the bucket and a target surface Fm of a target excavation landform. The Korean Patent No. 10-1475771 proposes that the degree of the inclination and the inclination distance are represented in text.

However, these conventional technologies have a problem that they cannot clearly show what the operator should do for the alignment due to the lack of visibility for the operator.

SUMMARY

Technical Problem

The present disclosure is intended to provide a display method for intuitively presenting information on the horizontal alignment between a bucket surface of an excavator and a target surface, when performing, by using a machine guidance program in the excavator, work such as a leveling work that requires precision work.

The technical problem to be overcome in the present disclosure is not limited to the above-mentioned technical problems. Other technical problems not mentioned can be clearly understood from those described below by a person having ordinary skill in the art.

Technical Solution

One embodiment is a machine guidance apparatus or a machine guidance program which assists an operator of an excavator including a bucket to operate. The machine guidance apparatus or the machine guidance program is configured to display a guidance screen on a display device. The guidance screen includes: a front view which includes a first icon indicating a front shape of the bucket and a first line indicating a target surface of a design drawing, and visually indicates a degree of alignment between an end section of the bucket and the target surface; a first guide indicator which guides in which tilting direction the operator should operate; a side view which includes a second icon indicating a side shape including a back face of the bucket and a second line indicating a side target surface of the design drawing, and visually indicates a degree of alignment between the back face of the bucket and the side target surface; and a second guide indicator which guides whether the operator should operate in a dump direction or in a crowd direction.

Another embodiment is an excavator including: a sensor device including an angle sensor of a pivot portion which connects a bucket and an upper body; a storage device in which a machine guidance program assisting an operator of the excavator when the operator controls a position of the bucket has been recorded; a display device; and a processor which executes the machine guidance program and displays a guidance screen on the display device.

The guidance screen includes: a front view which includes a first icon indicating a front shape of the bucket and a first line indicating a target surface of a design drawing, and visually indicates a degree of alignment between an end section of the bucket and the target surface; a first guide indicator which guides in which tilting direction the operator should operate; a side view which includes a second icon indicating a side shape including a back face of the bucket and a second line indicating a side target surface of the design drawing, and visually indicates a degree of alignment between the back face of the bucket and the side target surface; and a second guide indicator which guides whether the operator should operate in a dump direction or in a crowd direction.

Advantageous Effects

According to the embodiments of the present disclosure, when performing, by using a machine guidance program in a construction machine, work such as a leveling work that requires precision work, information on the horizontal alignment between a bucket surface of an excavator and a target surface is intuitively presented, so that the work efficiency of the construction machine can be increased.

In addition, the information on the horizontal alignment between the bucket surface of the excavator and the target surface is intuitively presented to the operator, so that even an unskilled operator can easily align the target surface and the bucket surface.

Advantageous effects that can be obtained from the present disclosure are not limited to the above-mentioned effects.

Further, other unmentioned effects can be clearly understood from the following descriptions by those skilled in the art to which the present disclosure belongs.

DETAILED DESCRIPTION

Figure 1:
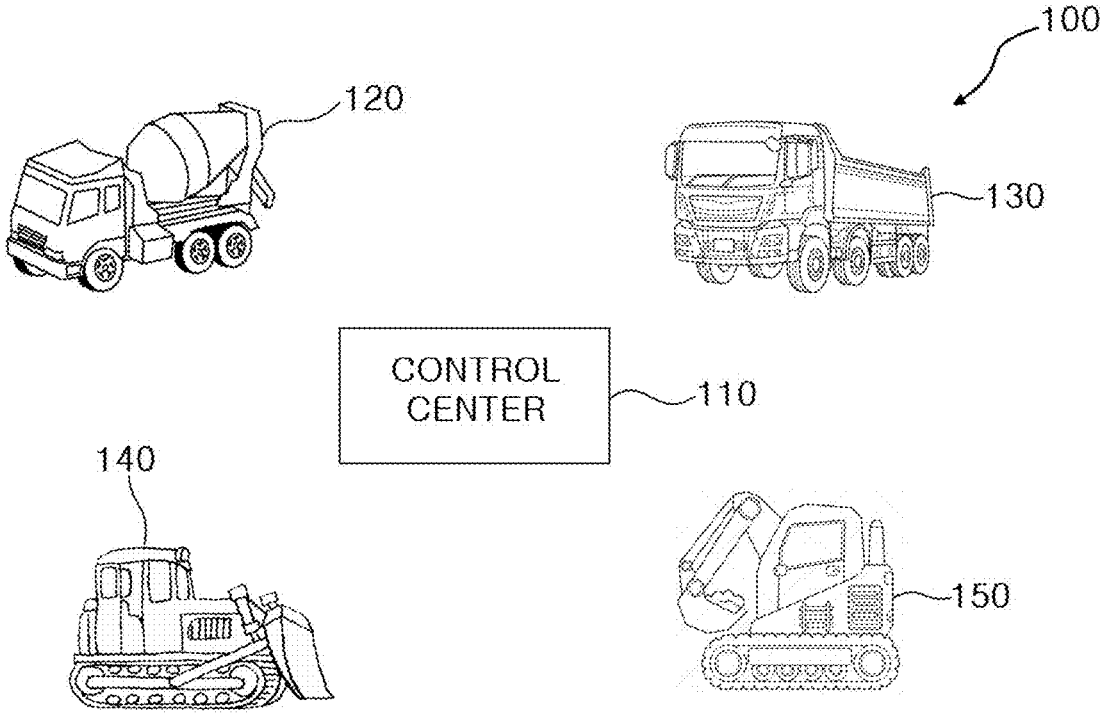
FIG. 1 is a view showing an autonomous work system according to various embodiments of the present disclosure.

The features, advantages and method for accomplishment of the present invention will be more apparent from referring to the following detailed embodiments described as well as the accompanying drawings. However, the present invention is not limited to the embodiment to be disclosed below and is implemented in different and various forms. The embodiments bring about the complete disclosure of the present invention and are provided to make those skilled in the art fully understand the scope of the present invention. The present invention is just defined by the scope of the appended claims. The same reference numerals throughout the disclosure correspond to the same elements.

What one component is referred to as being "connected to" or "coupled to" another component includes both a case where one component is directly connected or coupled to another component and a case where a further another component is interposed between them. Meanwhile, what one component is referred to as being "directly connected to" or "directly coupled to" another component indicates that a further another component is not interposed between them. The term "and/or" includes each of the mentioned items and one or more all of combinations thereof.

Terms used in the present specification are provided for description of only specific embodiments of the present invention, and not intended to be limiting. In the present specification, an expression of a singular form includes the expression of plural form thereof if not specifically stated. The terms "comprises" and/or "comprising" used in the specification is intended to specify characteristics, numbers, steps, operations, components, parts or any combination thereof which are mentioned in the specification, and intended not to exclude the existence or addition of at least one another characteristics, numbers, steps, operations, components, parts or any combination thereof.

While terms such as the first and the second, etc., can be used to describe various components, the components are not limited by the terms mentioned above. The terms are used only for distinguishing between one component and other components.

Therefore, the first component to be described below may be the second component within the spirit of the present invention. Unless differently defined, all terms used herein including technical and scientific terms have the same meaning as commonly understood by one of ordinary skill in the art to which the present invention belongs. Also, commonly used terms defined in the dictionary should not be ideally or excessively construed as long as the terms are not clearly and specifically defined in the present application.

A term "part" or "module" used in the embodiments may mean software components or hardware components such as a field programmable gate array (FPGA), an application specific integrated circuit (ASIC). The "part" or "module" performs certain functions. However, the "part" or "module" is not meant to be limited to software or hardware. The "part" or "module" may be configured to be placed in an addressable storage medium or to restore one or more processors. Thus, for one example, the "part" or "module" may include components such as software components, object-oriented software components, class components, and task components, and may include processes, functions, attributes, procedures, subroutines, segments of a program code, drivers, firmware, microcode, circuits, data, databases, data structures, tables, arrays, and variables. Components and functions provided in the "part" or "module" may be combined with a smaller number of components and "parts" or "modules" or may be further divided into additional components and "parts" or "modules".

Methods or algorithm steps described relative to some embodiments of the present invention may be directly implemented by hardware and software modules that are executed by a processor or may be directly implemented by a combination thereof. The software module may be resident on a RAM, a flash memory, a ROM, an EPROM, an EEPROM, a resistor, a hard disk, a removable disk, a CD-ROM, or any other type of record medium known to those skilled in the art. An exemplary record medium is coupled to a processor and the processor can read information from the record medium and can record the information in a storage medium. In another way, the record medium may be integrally formed with the processor. The processor and the record medium may be resident within an application specific integrated circuit (ASIC).

FIG. 1 is a view showing an autonomous working system 100 according to various embodiments of the present disclosure.

Referring to FIG. 1, the autonomous working system 100 according to various embodiments may include a control center 110 and at least one construction machine (or autonomous working construction machine) 120 to 150.

According to various embodiments, the construction machines 120 to 150 refer to machines that perform work at civil engineering sites or construction sites, and may include, as shown in FIG. 1, a mixer truck 120, a dump truck 130, a dozer 140, and an excavator 150. However, this is only illustrative, and the construction machine may include various machines such as a drilling machine, a crane, a wheel loader, a scraper, and the like.

According to the embodiment, an operator may perform work with the construction machines 120 to 150 in accordance with work instructions received from the control center 110. According to another embodiment, the construction machines 120 to 150 may autonomously perform work without the operator. The work instruction may include information related to a work area in which the construction machine has to perform the work, the work to be performed in the work area, and the like. For example, in accordance with the work instruction, the construction machines 120 to 150 may move to the work area without a user's operation or based on the user's operation and perform work.

The construction machines 120 to 150 may be provided with various sensors. Based on information obtained by the sensors, the construction machines 120 to 150 may sense the state of the construction machine and/or the surrounding environment of the construction machine, and may consider a result of the sensing in performing the work.

In addition, the construction machines 120 to 150 may be equipped with an instrument panel that can display information on the construction machines 120 to 150 or set control of the construction machines 120 to 150. According to the embodiment, since the instrument panel includes a touch sensor capable of receiving a user's touch input, it is possible to obtain information on which image in the instrument panel the user touches and executes. The construction machines 120 to 150 may collect the instrument panel touch information of the user and transmit it to the control center 110.

According to various embodiments, the control center 110 may manage the at least one construction machine 120 to 150 which is input to the work site. According to the embodiment, the control center 110 may give work instructions to the at least one construction machine 120 to 150. For example, the control center 110 may generate a work instruction defining a work area and a work to be performed in the work area, and may transmit them to the at least one construction machine 120 to 150.

Figure 2A:
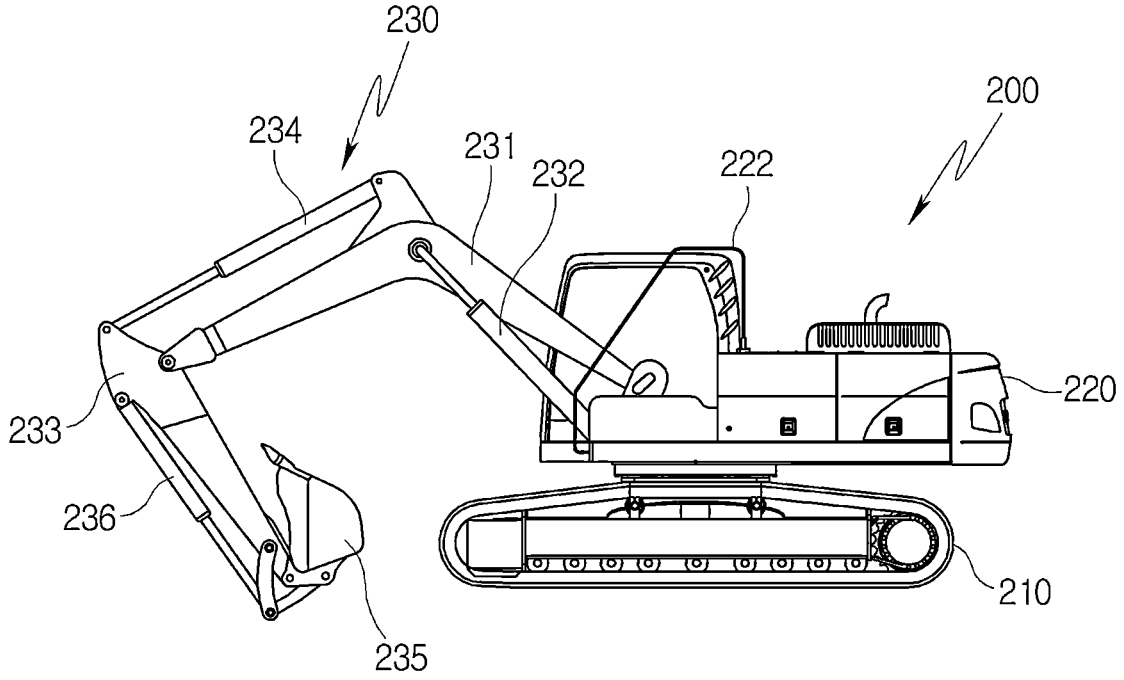
FIG. 2A is a view for describing an excavator according to various embodiments of the present disclosure.
Figure 2B:
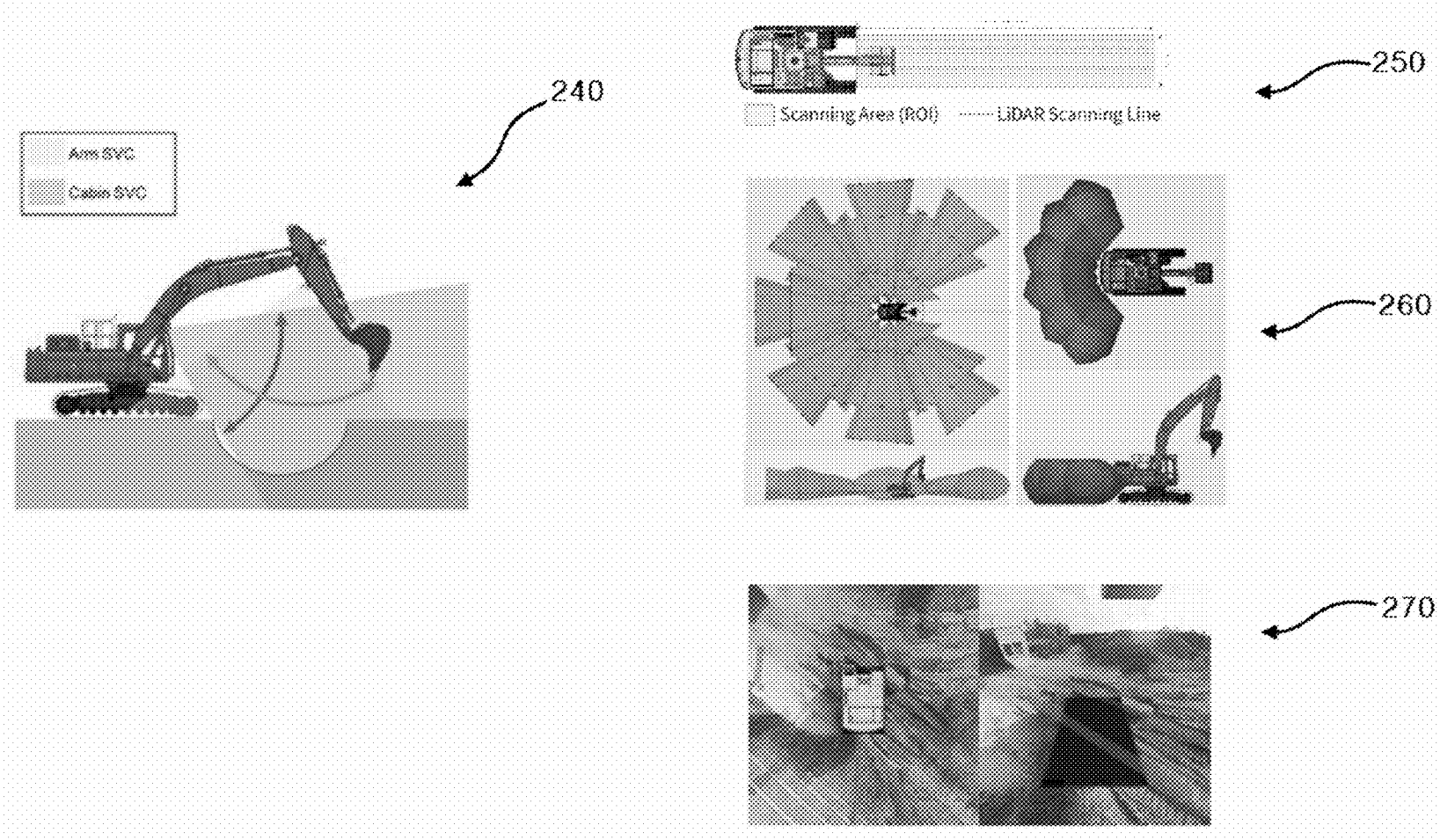
FIG. 2B is a view for describing a sensor provided in the excavator.

FIG. 2A is a view for describing the excavator according to various embodiments of the present disclosure. FIG. 2B is a view for describing a sensor provided in the excavator. In the following description, the excavator is described as an example of a construction machine, and the present disclosure is not limited to the excavator.

Referring to FIG. 2A, the excavator 200 includes a moving lower body 210, an upper body 220 which is mounted on the lower body 210 and rotates 360 degrees, and a front work part 230 coupled to the front of the upper body 220. However, this is only an example, and the embodiment of the present disclosure is not limited thereto. For example, in addition to the components of the excavator 200 described above, one or more other components (e.g., a plate coupled to the rear of the lower body 210) may be added.

According to various embodiments, the upper body 220 may include an operation cab 222 in which an operator boards and operates and may include an internal space (not shown) where a power generator (e.g., an engine) can be mounted. The operation cab 222 may be provided on a portion close to the work area. The work area is a space in which the excavator 200 works. The work area is located in front of the excavator 200. For example, the on-board operator may perform work under the obtained visual field, and the operation cab 222 may be, as shown in FIG. 2A, close to the work area and be located at a position biased to one side of the upper body 220, in consideration of the position where the front work part 230 is mounted.

According to various embodiments, the front work part 230 may be mounted on the top surface of the upper body 220 and may perform work such as land excavation, transportation of a heavy object, etc. According to the embodiment, the front work part 230 may include a boom 231 rotatably coupled to the upper body 220, a boom cylinder 232 which rotates the boom 231, an arm 233 rotatably coupled to the front end of the boom 231, an arm cylinder 234 which rotates the arm 233, a bucket 235 rotatably coupled to the front end of the arm 233, and a bucket cylinder 236 which rotates the bucket 235. During the operation of the excavator 200, one end of the boom 231, one end of the arm 233, and one end of the bucket 235 perform a rotational motion individually to maximize an area that the bucket 235 can reach. Since the aforementioned front work part 230 has been publicly known in many documents, the detailed description thereof will be omitted.

According to various embodiments, the lower body 210 may be coupled to the bottom surface of the upper body 220. The lower body 210 may include a carriage formed in a wheel type using wheels or in a crawler type using a caterpillar. The carriage may implement forward, backward, right, and left movements of the excavator 200 by using the power generated by the power generator as a driving force. According to the embodiment, the lower body 210 and the upper body 220 may be rotatably coupled by a center joint.

According to various embodiments, the excavator 200 may include a plurality of sensors for collecting information related to the state of the excavator and/or information related to the surrounding environment.

According to the embodiment, the plurality of sensors may include a first sensor for detecting the state of the excavator 200. For example, the state of the excavator 200 may include the rotational state of the upper body 220 (or the lower body 210). The first sensor may be disposed on the center joint and may detect the rotational state of the upper body 220. Also, the state of the excavator 200 may include the rotational state of the front work part 230. The first sensor may be disposed on the boom 231, the arm 233, and the bucket 235, respectively, or may be disposed on the joints (e.g., a hinge connection portion) of the boom 231, the arm 233, and the bucket 235, thereby at least detecting the rotational states of the boom 231, the arm 233, and the bucket 235, respectively. The location of the above-described first sensor is an example, and the present disclosure is not limited thereto. The first sensor may be disposed at various locations capable of detecting the state of the excavator 200.

According to the embodiment, the plurality of sensors may include a second sensor for detecting the work area in which the excavator 200 performs work. As described above, the work area is a space in which the excavator 200 works and may be located in front of the excavator 200. The second sensor may be disposed on a portion of the upper body 220, which is close to the work area, for example, on one side close to the front work part 230 on the top surface of the operation cab 222, and may detect the work area. However, this is only an example, and the location of the second sensor is not limited thereto. For example, the second sensor may be additionally or selectively disposed on the front work part 230, for example, on the arm 233 or the bucket 235 in order to detect the work area.

According to the embodiment, the plurality of sensors may include a third sensor for detecting obstacles around the excavator 200. The third sensor may be disposed in the front, side and rear of the upper body 220 and may detect obstacles around the excavator 200. The location of the above-described third sensor is an example, and the present disclosure is not limited thereto. The third sensor may be disposed at various locations capable of detecting obstacles around the excavator 200.

According to various embodiments, the various sensors described above may include an angle sensor, an inertial sensor, a rotation sensor, an electromagnetic wave sensor, a camera sensor, a radar, a lidar, an ultrasonic sensor, etc. For example, the first sensor may include at least one of the angle sensor, the inertial sensor, or the rotation sensor, and the second sensor and the third sensor may include at least one of the electromagnetic wave sensor, the camera sensor, the radar, the lidar, or the ultrasonic sensor. For example, as indicated by a reference numeral 240 of FIG. 2B, the camera sensor disposed on the top surface of the operation cab 222 and the arm 233 of the excavator 200 may be used as the second sensor. In addition, the lidar disposed on the front of the excavator 200 indicated by a reference numeral 250 of FIG. 2B, the ultrasonic sensor disposed on the side and rear of the excavator 200 indicated by a reference numeral 260 of FIG. 2B, or the camera sensor disposed on the front, side, and rear of the excavator 200 indicated by a reference numeral 270 of FIG. 2B may be used as the third sensor. Additionally or alternatively, when an image sensor is used as the second sensor and the third sensor, the image sensor may be composed of a stereo vision system capable of obtaining an image showing the distance information of an object.

In addition, the first sensor, the second sensor, and the third sensor may perform the same or similar operation to each other. For example, by using the third sensor for detecting obstacles around the excavator 200, the operation of the second sensor for detecting the work area in which the excavator 200 performs work may be performed.

According to various embodiments, the excavator 200 may include at least one positioning device.

According to the embodiment, a global navigation satellite system (GNNS) module capable of receiving a satellite signal may be used as the positioning device, and a real time kinematic (RTK) GNSS module may be used for precise measurement. For example, at least one positioning device may be disposed on the upper body 220 of the excavator 200.

Figure 2C:
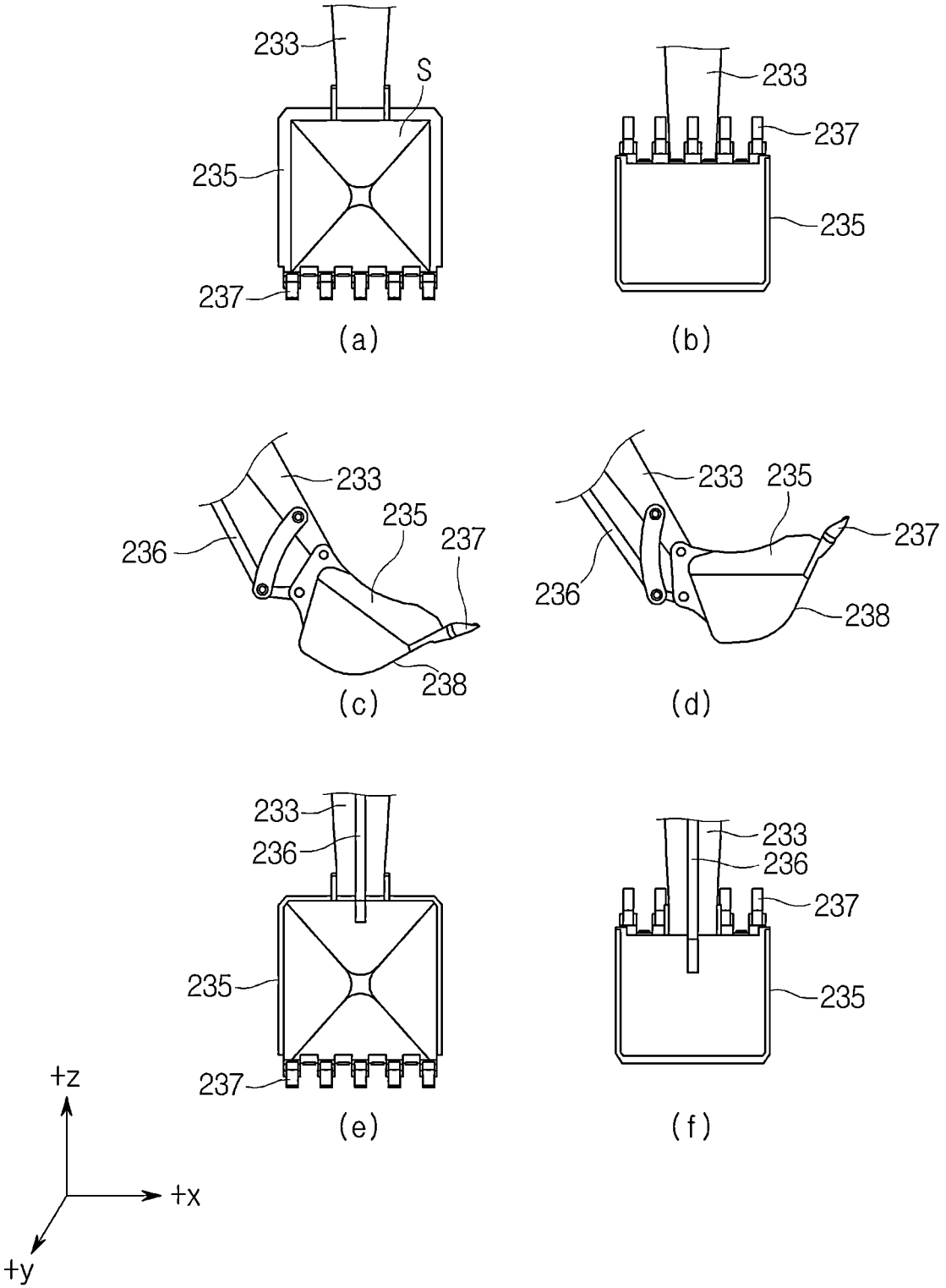
FIG. 2C is a view for describing a rotational motion of the bucket.

FIG. 2C is a view for describing the rotational motion of the bucket 235.

Referring to FIG. 2C, the bucket 235 may rotate along the YZ plane in the +Z direction and the −Z direction by the bucket cylinder 236. Also, the bucket 235 may be tilted in the XZ plane in the +Z direction and the −Z direction by a tilting device.

Front views of the bucket 235 are shown in (a) and (b) of FIG. 2C. An example in which the bucket rotates as much as possible in the −Z direction is shown in (a). This can be called a dump state. An example in which the bucket rotates as much as possible in the +Z direction is shown in (b). This can be called a crowd state. Side views of the bucket are shown in (c) and (d). Rear views of the bucket are shown in (e) and (f).

In the following description, a dump direction may mean a −Z direction for becoming the dump state, and a crowd direction may mean a +Z direction for becoming the crowd state.

In FIG. 2C, an end section 239 of the bucket may be a line connecting end points of teeth 237 of the bucket. In addition, a portion extending from the teeth 237 of the bucket to the rear surface of the bucket in an almost straight line may be a back face 238 of the bucket.

When a dumping rotation is performed by the bucket cylinder 236, the entire end section of the bucket may move in the +Z direction or in the −Z direction.

When tilting is performed by the tilting device (not shown), one end of the end section of the bucket 235 may go up in the +Z direction or go down in the −Z direction, and contrary to this, the other opposite end of the end section of the bucket 235 may go down in the −Z direction or go up in the +Z direction. According to the embodiment, in the front view shown in (a) of FIG. 2C, the direction in which the left end of the end section goes up may be set to a (+) tilting direction, and the direction in which the left end of the end section goes down may be set to a (−) tilting direction.

Figure 3:
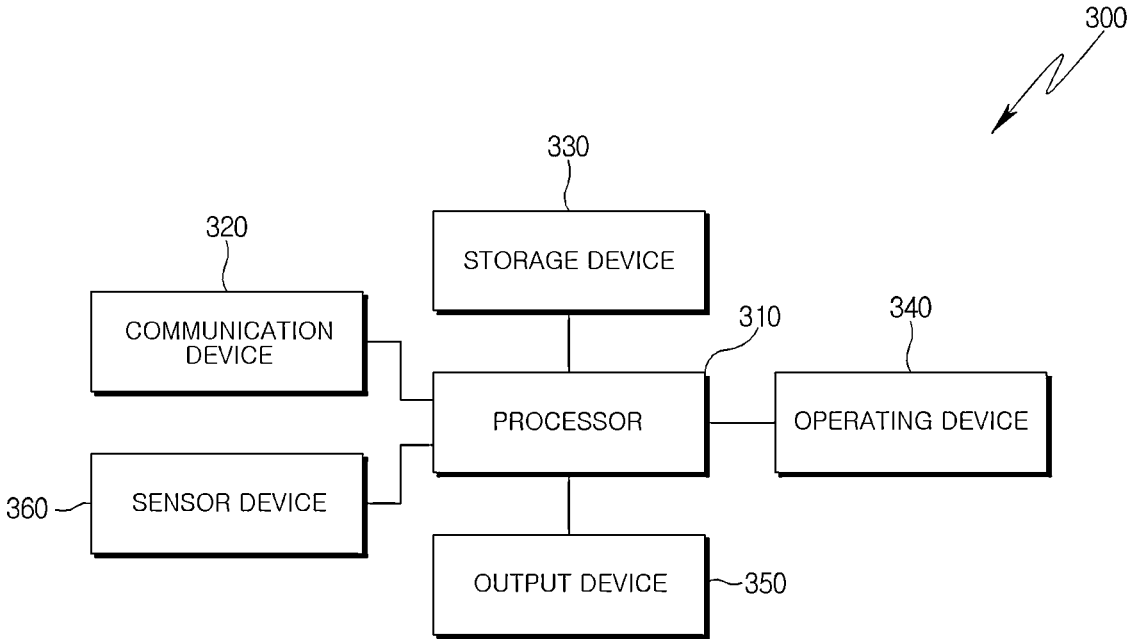
FIG. 3 is a view conceptually showing an excavator according to various embodiments of the present disclosure.

FIG. 3 is a view conceptually showing an excavator 300 according to various embodiments of the present disclosure.

Referring to FIG. 3, the excavator 300 may include a processor 310, a communication device 320, a storage device 330, an operating device 340, an output device 350, and a sensor device 360. However, this is only an example, and the embodiment of the present disclosure is not limited thereto. For example, at least one of the above-described components of the excavator 300 may be omitted or one or more other components may be added to the configuration of the excavator 300.

According to various embodiments, the communication device 320 may transmit/receive data to and from an external device by using a wireless communication technology. The external device may include a control center 110, other display devices (e.g., a smartphone, a laptop, a tablet PC, etc.) and/or other construction machines. Here, communication technologies used by the communication device 320 include global system for mobile communication (GSM), code division multi access (CDMA), long term evolution (LTE), 5G, wireless LAN (WLAN), wireless-fidelity (Wi-Fi), Bluetooth, radio frequency identification (RFID), infrared data association (IrDA), ZigBee, near field communication (NFC), and the like. Also, as described above with reference to FIGS. 2A and 2B, the communication device 320 may include at least one positioning device.

According to various embodiments, the storage device 330 may store a variety of data used by at least one component of the excavator 300 (e.g., the processor 310, the communication device 320, the operating device 340, the output device 350, or the sensor device 360). According to the embodiment, the storage device 330 may store specifications (e.g., a model name, a serial number, and basic specifications) of the excavator 300, map data, and the like. According to the embodiment, the storage device 330 may store a design drawing to be worked by the excavator 300. The design drawing may be directly stored in the storage device 330 by the user, or the excavator 300 is connected to the control center 110 through the communication device 320, thereby obtaining the design drawing and storing in the storage device 330. Some information of the design drawing may be displayed on a guidance screen to be described later. For example, the storage device 330 may include at least one of a non-volatile memory device and a volatile memory device.

According to various embodiments, the operating device 340 may receive a command or data to be used for operation control of the excavator 300. The operating device 340 includes an operating lever for operating at least a portion of the front work part 230 (e.g., the boom 231, the arm 233, and the bucket 235), a handle for operating the steering of the lower body 210, and a shift lever for operating the moving speed of the excavator 300 or forward and backward traveling, and the like. According to the embodiment, the operating device 340 may be provided in the operation cab 222 described above with reference to FIG. 2A.

According to various embodiments, the output device 350 may generate an output related to the operation of the excavator 300. According to the embodiment, the output device 350 may include a display device which outputs visual information, an audio data output device which outputs auditory information, and a haptic module which outputs tactile information. For example, the display device may include a liquid crystal display (LCD), a light emitting diode (LED) display, an organic light emitting diode (OLED) display, or a microelectromechanical system (MEMS) display, or electronic paper or the like. Also, the audio data output device may include at least one of a speaker, an earphone, an earset, and a headset which are included in the excavator 300 or connected to the excavator 300 in a wired or wireless manner.

According to various embodiments, as shown in FIG. 2B, the sensor device 360 may include the first sensor for detecting the state of the excavator 300, the second sensor for detecting the work area in which the excavator 300 performs work, and/or the third sensor for detecting obstacles around the excavator 300. In addition to this, sensors required for the operation of the excavator 300 may be added.

According to various embodiments, the processor 310 may be configured to control the overall operation of the excavator 300. According to the embodiment, the processor 310 executes software (e.g., a program) stored in the storage device 330, thereby controlling at least one of the components connected to the processor 310 (e.g., the communication device 320, the storage device 330, the operating device 340, the output device 350, or the sensor device 360). The processor 310 may perform various data processing or operations. For example, as at least a part of data processing or operation, the processor 310 may store instructions or data received from other components in the storage device 330, process the instructions or data stored in the storage device 330, and store the result data in the storage device 330. The processor 310 may include a main processor and an auxiliary processor which can be operated independently of or together with the main processor. According to the embodiment, the processor 310 may perform a controller area network (CAN) communication with the aforementioned components (e.g., the communication device 320, the storage device 330, the operating device 340, the output device 350 or the sensor device 360), and the present disclosure is not limited thereto.

The operator may perform work transmitted from the control center 110, by operating the excavator configured as shown in FIGS. 2A, 2B, and/or FIG. 3. According to the embodiment, the work may be a precise leveling work. When the operator performs the leveling work, the correct and efficient work can be performed only by making a horizontal alignment between a bucket surface of the excavator 300 and a target surface on which the leveling work has to be performed.

When the operator intends to make the horizontal alignment between the target surface and the bucket surface of the excavator 300, a machine guidance apparatus or a machine guidance program built in the excavator 300 may assist the operator to operate. According to the embodiment, the excavator 300 may obtain position information of the bucket 235 by using the angle sensor of a pivot portion which connects the upper body 220 and the bucket of the sensor device 360. According to another embodiment, the excavator 300 may obtain an image of the work area including the bucket by using the camera sensor of the sensor device 360, and may obtain the position information of the bucket from the image. The processor 310 executing the machine guidance program may determine the degree of alignment between the bucket surface and the target surface on the basis of the position information of the bucket, and may display, on the display device of the output device 350, an indicator indicating the degree of alignment between the bucket surface and the target surface. This indicator should be intuitively represented such that the operator can immediately recognize how to operate the excavator 300 in order to make the alignment between the target surface and the bucket surface. In this case, the efficiency of work can be increased.

Figure 4:
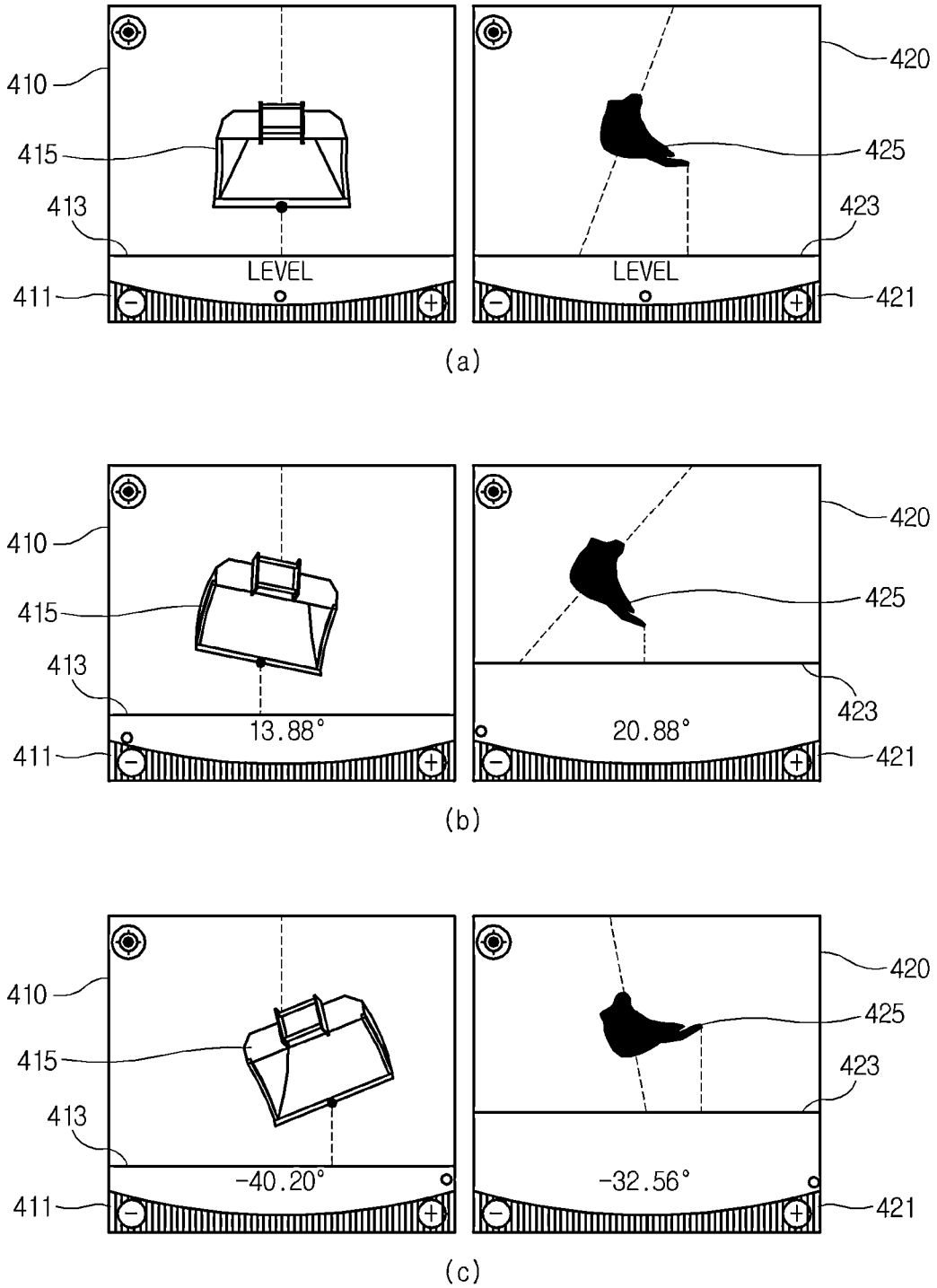
FIG. 4 is a view showing a guidance screen according to various embodiments of the present disclosure.

FIG. 4 is a view showing a guidance screen according to various embodiments of the present disclosure.

For description of FIG. 4 and the following figures, while the guidance screen is described as including a front view showing the front of the bucket shown in (a) of FIG. 2C, the guidance screen is not limited thereto. The guidance screen may include a rear view including the back face of the bucket shown in (e) of FIG. 2C instead of the front view. The rear view also shows visually the end section of the bucket for alignment. The rear view may perform the same function as that of the front view in providing alignment information to be described below.

Referring to FIG. 4, the guidance screen may include a bucket-shaped icon 415 and a line 413 indicating the target surface of the design drawing. The guidance screen may include a front view 410 which visually indicates the degree of alignment between the end section of the bucket and the target surface of the design drawing, a guide indicator 411 which is located in the lower portion of the front view 410 and guides in which tilting direction the operator should operate, an icon 425 which indicates the side shape of the bucket including the back face of the bucket, and a line 423 which indicates a side target surface of the design drawing. The guidance screen may include a side view 420 which visually indicates the degree of alignment between the back face of the bucket and the target surface of the design drawing, and a guide indicator 421 which is located in the lower portion of the side view 420 and guides which direction among the dump direction and the crowd direction the operator should operate in.

In the front view 410, the bucket-shaped icon 415 may be, as shown in (a), (b), and (c) of FIG. 4, displayed aligned or tilted according to the degree of alignment between the end section of the bucket and the target surface of the design drawing.

The guide indicator 411 in the lower portion of the front view may include a ball shape and a series of bars supporting the ball. The length of the series of bars may increase toward the left and right from the center. However, this is only an example and the series of bars may be displayed in another shape, and as another shape, one bar may be displayed from the left end to the right end. In addition, unlike what is shown in FIG. 4, the guide indicator 411 may also be located in the upper portion of the front view 410.

The ball shape of the guide indicator 411 can move left and right depending on the degree of alignment on the series of bars. Also, a (−) indicator is placed near the left end of the area marked with the series of bars, and this may represent that the operator should operate in the (−) tilting direction on the basis of an angle between the end section of the bucket and the target surface of the design drawing. Also, a (+) indicator is placed near the right end, and this may represent that the operator should operate in the (+) tilting direction.

When the end section of the bucket and the target surface of the design drawing are exactly aligned, the ball shape of the guide indicator 411 may be, as shown in (a) of FIG. 4, positioned at the center of the series of bars. When the end section of the bucket and the target surface of the design drawing are not aligned and thus the operator is guided in the (−) tilting direction, the ball shape may move, as shown in (b) of FIG. 4, toward the left end of the guide indicator 411. When the end section of the bucket and the target surface of the design drawing are not aligned and thus the operator is guided in the (+) tilting direction, the ball shape may move, as shown in (c) of FIG. 4, toward the right end of the guide indicator 411. Here, if the size of an angle between the end section of the bucket and the target surface of the design drawing is greater than a predetermined angle, the ball shape is positioned at the left or right end, and if the size of the angle between the end section of the bucket and the target surface of the design drawing is greater than 0 and smaller than the predetermined angle, the ball shape is positioned between the center and the left end or between the center and the right end depending on the size of the angle, thereby guiding the operator to the degree of tilting. Here, as an embodiment, the angle formed by the end section of the bucket and the target surface of the design drawing may be displayed in the form of text under the line 413 indicating the central target surface of the front view 410.

According to the embodiment, a color of the series of bars may be changed according to the position change of the ball shape of the guide indicator 411. Referring to the example of FIG. 4, if the end section of the bucket and the target surface of the design drawing are aligned, the series of bars may be, as shown in (a) of FIG. 4, represented by a first color (e.g., green), and if not aligned, the series of bars may be, as shown in (b) or (c) of FIG. 4, represented by a second color (e.g., gray) regardless of the degree of non-alignment.

According to another embodiment, if the end section of the bucket and the target surface of the design drawing are aligned, the series of bars may be, as shown in (a) of FIG. 4, represented by the first color (e.g., green). If the size of the angle between the end section of the bucket and the target surface of the design drawing is greater than a predetermined angle and thus the ball shape is positioned at the left or right end, all of the series of bars may be represented by the second color (e.g., gray). On the other hand, if the size of the angle between the end section of the bucket and the target surface of the design drawing is greater than 0 and smaller than the predetermined angle, the ball shape may be positioned at a point between the center and the left end or at a point between the center and the right end. When the ball shape is on the left side, the series of bars from the left end to the position of the ball shape may be represented by the first color, and the others may be represented by the second color. Also, when the ball shape is on the right side, the series of bars from the right end to the position of the ball shape may be represented by the first color, and the others may be represented by the second color. In this case, the ball shape may have a third color different from the first color and the second color.

The guidance screen shown in FIG. 4 includes the bucket-shaped icon 415 and the line 413 indicating the target surface of the design drawing, and displays both the front view 410 showing the alignment relationship between them, and the guide indicator 411 including the ball shape and the series of bars. As a result, the operator is able to intuitively recognize in which direction (left direction or right direction) to perform the tilting operation with respect to the current bucket.

In the side view 420, the icon 425 indicating the side shape of the bucket including the back face of the bucket may be, as shown in (a), (b), and (c) of FIG. 4, displayed aligned or tilted in accordance with the degree of alignment between the back face of the bucket and the target surface of the design drawing.

As with the guide indicator 411 of the front view 410, the guide indicator 421 of the side view 420 may include a ball shape and a series of bars supporting the ball. The length of the series of bars may increase toward the left and right from the center. However, this is only an example and the series of bars may be displayed in another shape, and as another shape, one bar may be displayed from the left end to the right end. In addition, unlike what is shown in FIG. 4, the guide indicator 421 may also be located in the upper portion of the side view 420.

The ball shape of the guide indicator 421 can move left and right depending on the degree of alignment on the series of bars. Also, a (−) indicator is placed near the left end of the area marked with the series of bars, and this may represent that the operator should operate in the crowd direction on the basis of an angle between the back face of the bucket and the target surface of the design drawing. Also, a (+) indicator is placed near the right end, and this may represent that the operator should operate in the dump direction.

When the back face of the bucket and the target surface of the design drawing are exactly aligned, the ball shape of the guide indicator 411 may be, as shown in (a) of FIG. 4, positioned at the center of the series of bars. When the end section of the bucket and the target surface of the design drawing are not aligned and thus the operator is guided to the operation in the crowd direction, the ball shape may move, as shown in (b) of FIG. 4, toward the left end of the guide indicator 421. When the back face of the bucket and the target surface of the design drawing are not aligned and thus the operator is guided to the operation in the dump direction, the ball shape may move, as shown in (c) of FIG. 4, toward the right end of the guide indicator 411. Here, if the size of an angle between the back face of the bucket and the target surface of the design drawing is greater than a predetermined angle, the ball shape is positioned at the left or right end, and if the size of the angle between the back face of the bucket and the target surface of the design drawing is greater than 0 and smaller than the predetermined angle, the ball shape is positioned between the center and the left end or between the center and the right end depending on the size of the angle, thereby guiding the operator to the degree of operation. Here, as an embodiment, the angle formed by the back face of the bucket and the target surface of the design drawing may be displayed in the form of text under the line 423 indicating the side target surface of the front view 410 in the center of the side view 420.

According to the embodiment, a color of the series of bars may be changed according to the position change of the ball shape of the guide indicator 421. Referring to the example of FIG. 4, if the back face of the bucket and the target surface of the design drawing are aligned, the series of bars may be, as shown in (a) of FIG. 4, represented by a first color (e.g., green), and if not aligned, the series of bars may be, as shown in (b) or (c) of FIG. 4, represented by a second color (e.g., gray) regardless of the degree of non-alignment.

According to another embodiment, if the back face of the bucket and the target surface of the design drawing are aligned, the series of bars may be, as shown in (a) of FIG. 4, represented by the first color (e.g., green). If the size of the angle between the back face of the bucket and the target surface of the design drawing is greater than a predetermined angle and thus the ball shape is positioned at the left or right end, all of the series of bars may be represented by the second color (e.g., gray). On the other hand, if the size of the angle between the back face of the bucket and the target surface of the design drawing is greater than 0 and smaller than the predetermined angle, the ball shape may be positioned at a point between the center and the left end or at a point between the center and the right end. When the ball shape is on the left side, the series of bars from the left end to the position of the ball shape may be represented by the first color, and the others may be represented by the second color. Also, when the ball shape is on the right side, the series of bars from the right end to the position of the ball shape may be represented by the first color, and the others may be represented by the second color. In this case, the ball shape may have a third color different from the first color and the second color.

The guidance screen shown in FIG. 4 includes the icon 425 indicating the side shape of the bucket, and the line 423 indicating the side target surface of the design drawing, and displays both the front view 420 showing the alignment relationship between them, and the guide indicator 421 including the ball shape and the series of bars. As a result, the operator is able to intuitively recognize in which direction (dump direction or crowd direction) to operate with respect to the current bucket.

Figure 5A:
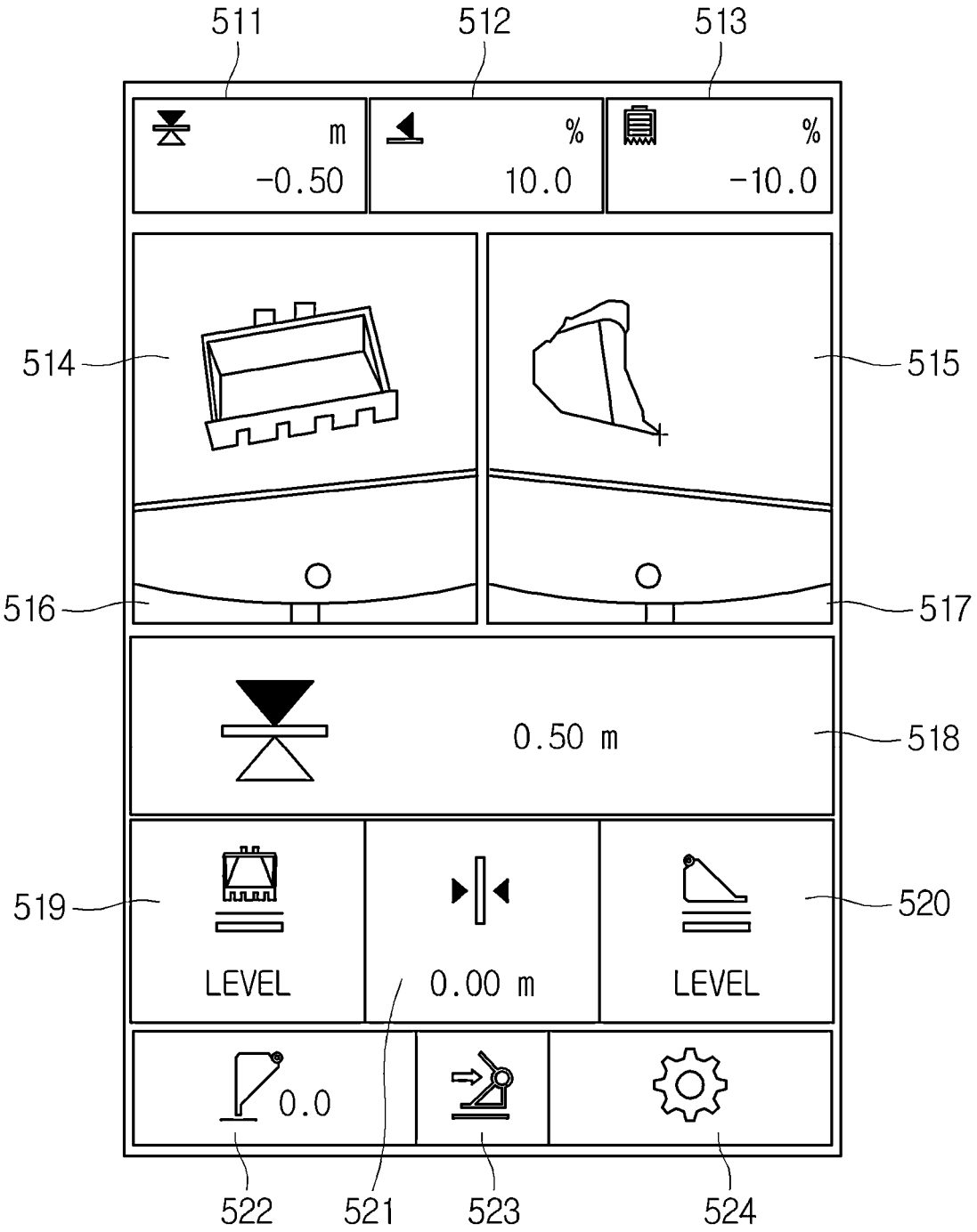
FIGS. 5A, 5B, and 5C are views showing another guidance screen according to various embodiments of the present disclosure.
Figure 5B:
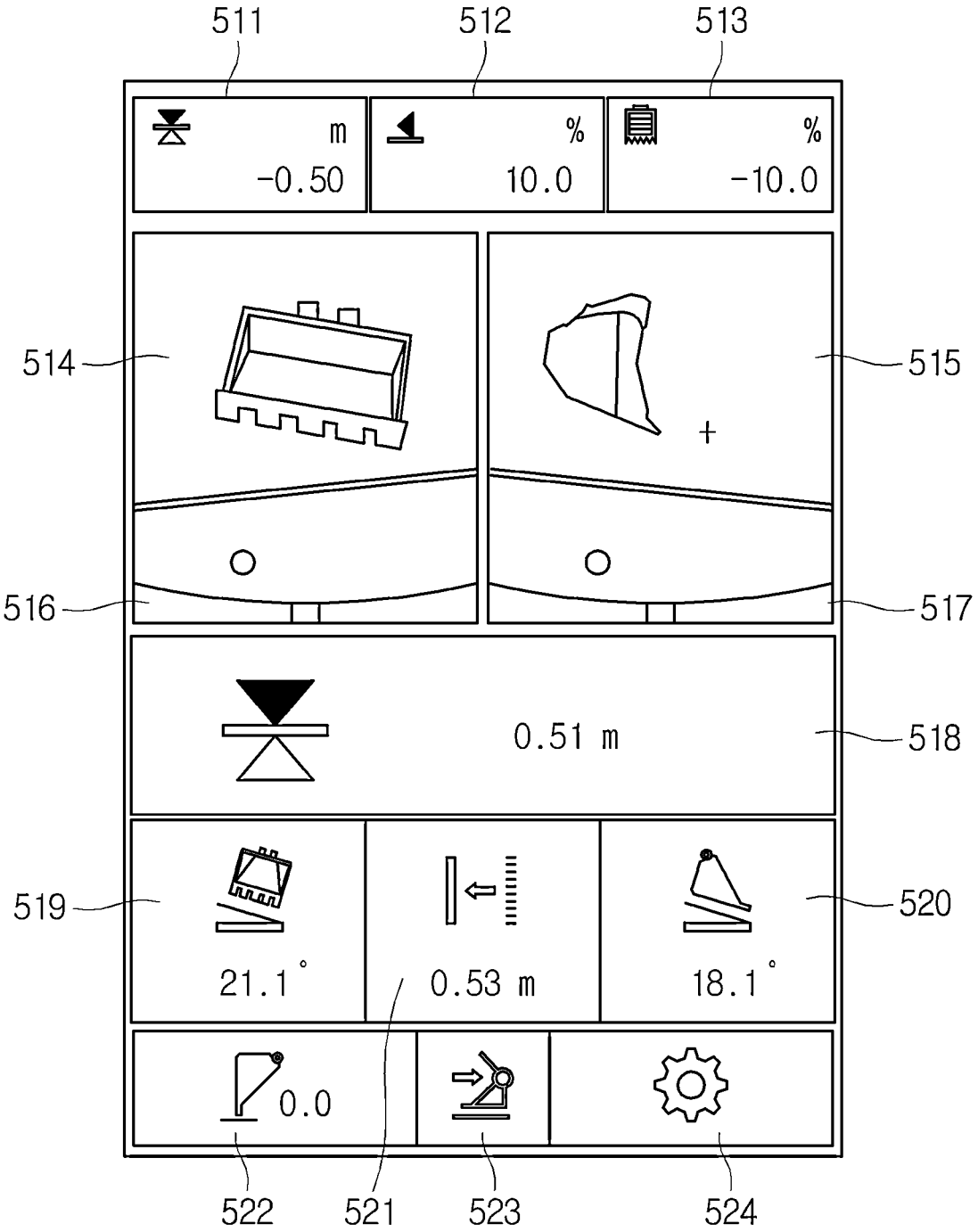
Figure 5C:
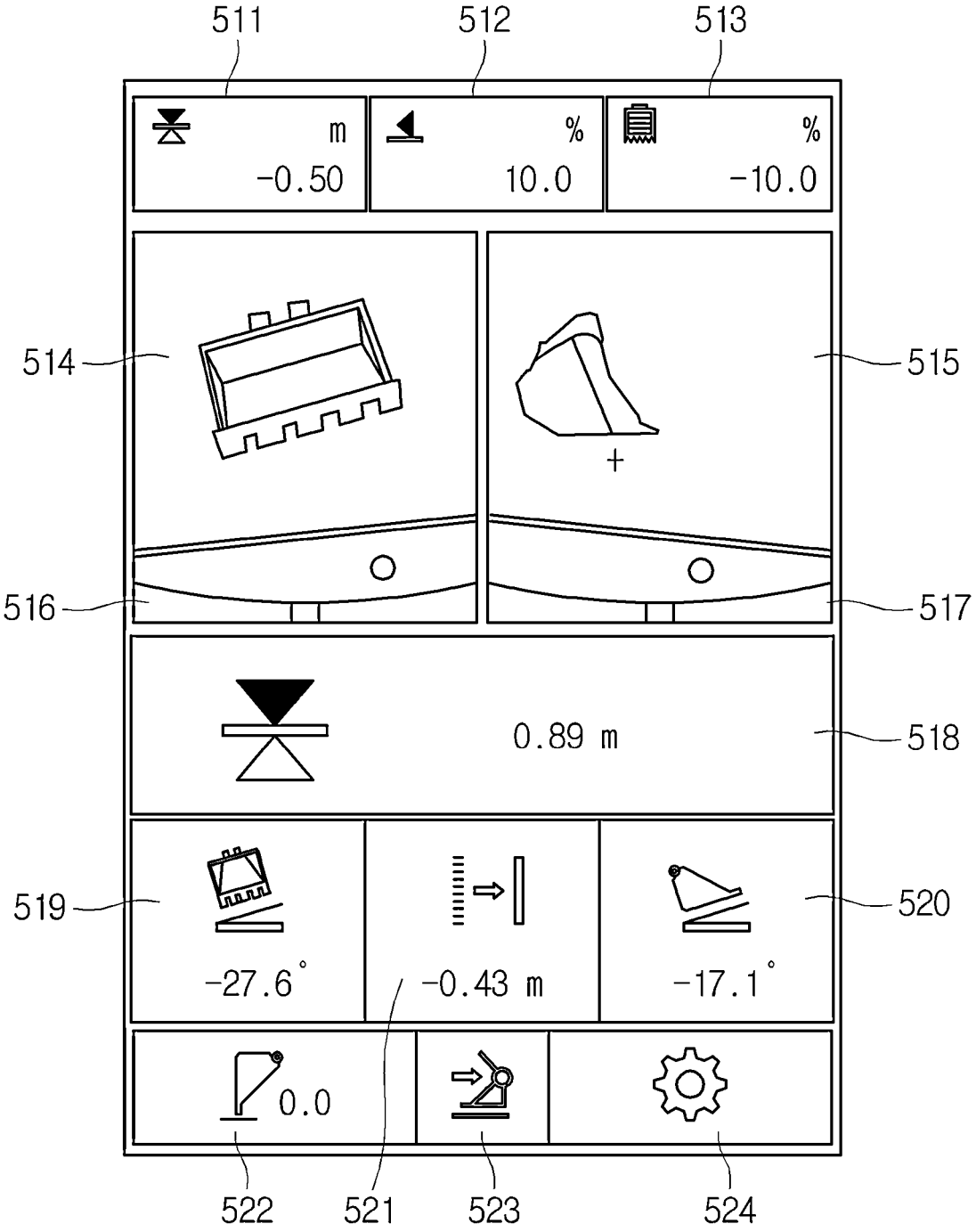

FIGS. 5A, 5B, and 5C are views showing another guidance screen according to various embodiments of the present disclosure.

FIGS. 5A to 5C may show the guidance screen of FIG. 4 to which a configuration for providing additional information is added according to the embodiment.

According to the embodiment, FIG. 5A shows the guidance screen when the horizontal alignment is made between the target line and the bucket surface. FIG. 5B shows that the guidance screen guides the right tilting direction and the bucket crowd direction when the horizontal alignment is not made between the target line and the bucket surface. FIG. 5C shows the guidance screen guides the left tilting direction and the bucket dump direction when the horizontal alignment is not made between the target line and the bucket surface.

The guidance screen configuration shown in FIGS. 5A to 5C is one embodiment and may be made in another form. Also, an additional component (e.g., a channel view displaying a camera image showing the work area) is further included or some components may be removed.

Referring to the guidance screens of FIGS. 5A to 5C, the guidance screen may include a front view 514 including the bucket-shaped icon viewed from the front and the line indicating the target surface in the design, a side view 515 including the bucket-shaped icon including the back face of the bucket viewed from the side and the line indicating the target surface in the design, and guide indicators 516 and 517 which guide the operator to the operations for the horizontal alignment. According to the embodiment, the guide indicator 516 may guide the operator in the tilting direction on the basis of the angle between the end section of the bucket and the target surface shown in the front view 514. The guide indicator 517 may guide the operator in the dump direction or the crowd direction on the basis of the angle between the back face of the bucket and the target surface shown in the side view 515.

Additionally, the guidance screen may show a vertical distance 518 between the end of the bucket and the target surface, and may include an angle 519 between the end of the bucket and the target surface, an angle 520 between the back face of the bucket and the target surface, a horizontal travel distance 521 from a reference point position to a current bucket position, a target depth value 511, a target tilt value 512 viewed from the side, and a target tilt value 513 viewed from the front.

Besides, the guidance screen may further show a reference point set button 522, a reference point set method button 523, and a machine guidance related set enter button 524.

According to the embodiment, the end of the bucket of the excavator is placed at an actual reference position and the reference point set button 522 is pressed or touched, the corresponding position may be set as a reference point. Also, target depth value 511, the target tilt value 512 viewed from the side, and the target tilt value 513 viewed from the front through a separate menu on the basis of the reference point or may be set by receiving the design drawing from the control center 110.

As shown in FIG. 5A, 5B or 5C, the guidance screen which is supplied with information by the machine guidance program may display horizontal alignment information of the target line and the bucket.

The guidance screen may use the front view 514 and the guide indicator 516 to visually provide the operator with whether the target line and the end of the bucket are horizontal, and may also show the tilting directional operation that has to be performed by the operator in order to perform to make the horizontal alignment between the target line and the end of the bucket. The guidance screen may use the side view 515 and the guide indicator 517 to visually provide the operator with whether the target line and the back face of the bucket are horizontal, and may also show the dump/crowd directional operation that has to be performed by the operator in order to perform to make the horizontal alignment between the target line and the back face of the bucket.

According to various embodiments of the present disclosure, the machine guidance program that assists the operator to operate the excavator including the bucket may be configured to display the guidance screen on the display device. The guidance screen includes the front view which includes a first icon indicating the front shape of the bucket and a first line indicating the target surface of the design drawing, and visually indicates the degree of alignment between the end section of the bucket and the target surface, a first guide indicator which guides in which tilting direction the operator should operate, a side view which includes a second icon indicating the side shape including the back face of the bucket and a second line indicating the side target surface of the design drawing, and visually indicates the degree of alignment between the back face of the bucket and the side target surface, and a second guide indicator which guides whether the operator should operate in the dump direction or in the crowd direction.

According to various embodiments of the present disclosure, each of the first guide indicator and the second guide indicator may include a series of bars and a ball shape which can move left and right on the series of bars. The length of the series of bars may gradually increase toward the left or right from the center.

According to various embodiments of the present disclosure, when the horizontal alignment is made between the end section of the bucket and the target surface of the design drawing, the ball shape of the first guide indicator is displayed positioned at the center of the series of bars. When the horizontal alignment is not made between the end section of the bucket and the target surface of the design drawing and the bucket needs to be tilted to the left for the horizontal alignment, the ball shape is displayed positioned on the left from the center of the series of bars, and when the horizontal alignment is not made between the end section of the bucket and the target surface of the design drawing and the bucket needs to be tilted to the right for the horizontal alignment, the ball shape is displayed positioned on the right from the center of the series of bars.

According to various embodiments of the present disclosure, when the horizontal alignment is made between the back face of the bucket and the side target surface of the design drawing, the ball shape of the second guide indicator is displayed positioned at the center of the series of bars. When the horizontal alignment is not made between the back face of the bucket and the side target surface of the design drawing and the bucket needs to be tilted in the crowd direction for the horizontal alignment, the ball shape is displayed positioned on the left from the center of the series of bars, and when the horizontal alignment is not made between the back face of the bucket and the side target surface of the design drawing and the bucket needs to be tilted in the dump direction for the horizontal alignment, the ball shape is displayed positioned on the right from the center of the series of bars.

According to various embodiments of the present disclosure, when the horizontal alignment is made between the end section of the bucket and the target surface of the design drawing, the series of bars of the first guide indicator may be represented in a first color. When the horizontal alignment is not made between the end section of the bucket and the target surface of the design drawing, the series of bars may be represented in a second color different from the first color.

According to various embodiments of the present disclosure, when the horizontal alignment is made between the back face of the bucket and the side target surface of the design drawing, the series of bars of the second guide indicator may be represented in a first color. When the horizontal alignment is not made between the back face of the bucket and the side target surface of the design drawing, the series of bars of the second guide indicator may be represented in a second color different from the first color.

According to various embodiments of the present disclosure, in each of the first guide indicator and the second guide indicator, a (−) indicator may be displayed at the left end of the area composed of the series of bars, and a (+) indicator may be displayed at the right end of the area composed of the series of bars.

According to various embodiments of the present disclosure, the front view may additionally show, below the first line, the angle between the end section of the bucket and the target surface, and the side view may additionally show, below the second line, the angle between the back face of the bucket and the side target surface.

According to various embodiments of the present disclosure, the guidance screen may additionally include the angle between the end section of the bucket and the target surface, the angle between the back face of the bucket and the side target surface, the horizontal travel distance from the reference point position to the current bucket position, the target depth value set based on the reference point position, the target tilt value viewed from the front, and the target tilt value viewed from the side.

According to various embodiments of the present disclosure, the guidance screen may additionally include the reference point set button for setting the current bucket position as the reference point position, and the reference point set method button for setting the reference point set method.

According to various embodiments of the present disclosure, the excavator may include the sensor device including the angle sensor of the pivot portion which connects the bucket and the upper body, the storage device in which the machine guidance program assisting the operator of the excavator when the operator controls the position of the bucket has been recorded, the display device, and the processor which executes the machine guidance program and displays the guidance screen on the display device. The processor may display the guidance screen on the display device. The guidance screen includes the front view which includes a first icon indicating the front shape of the bucket and a first line indicating the target surface of the design drawing, and visually indicates the degree of alignment between the end section of the bucket and the target surface, a first guide indicator which guides in which tilting direction the operator should operate, a side view which includes a second icon indicating the side shape including the back face of the bucket and a second line indicating the side target surface of the design drawing, and visually indicates the degree of alignment between the back face of the bucket and the side target surface, and a second guide indicator which guides whether the operator should operate in the dump direction or in the crowd direction.

According to various embodiments of the present disclosure, in the processor, each of the first guide indicator and the second guide indicator may include the series of bars and the ball shape which can move left and right on the series of bars. The length of the series of bars may gradually increase toward the left or right from the center.

According to various embodiments of the present disclosure, in the processor, when the horizontal alignment is made between the end section of the bucket and the target surface of the design drawing, the ball shape of the first guide indicator is displayed positioned at the center of the series of bars. When the horizontal alignment is not made between the end section of the bucket and the target surface of the design drawing and the bucket needs to be tilted to the left for the horizontal alignment, the ball shape is displayed positioned on the left from the center of the series of bars, and when the horizontal alignment is not made between the end section of the bucket and the target surface of the design drawing and the bucket needs to be tilted to the right for the horizontal alignment, the ball shape is displayed positioned on the right from the center of the series of bars.

According to various embodiments of the present disclosure, in the processor, when the horizontal alignment is made between the back face of the bucket and the side target surface of the design drawing, the ball shape of the second guide indicator is displayed positioned at the center of the series of bars. When the horizontal alignment is not made between the back face of the bucket and the side target surface of the design drawing and the bucket needs to be tilted in the crowd direction for the horizontal alignment, the ball shape is displayed positioned on the left from the center of the series of bars, and when the horizontal alignment is not made between the back face of the bucket and the side target surface of the design drawing and the bucket needs to be tilted in the dump direction for the horizontal alignment, the ball shape is displayed positioned on the right from the center of the series of bars.

According to various embodiments of the present disclosure, in the processor, when the horizontal alignment is made between the end section of the bucket and the target surface of the design drawing, the series of bars of the first guide indicator may be represented in a first color. When the horizontal alignment is not made between the end section of the bucket and the target surface of the design drawing, the series of bars may be represented in a second color different from the first color.

According to various embodiments of the present disclosure, in the processor, when the horizontal alignment is made between the back face of the bucket and the side target surface of the design drawing, the series of bars of the second guide indicator may be represented in a first color. When the horizontal alignment is not made between the back face of the bucket and the side target surface of the design drawing, the series of bars may be represented in a second color different from the first color.

According to various embodiments of the present disclosure, in the processor, in each of the first guide indicator and the second guide indicator, a (−) indicator may be displayed at the left end of the area composed of the series of bars, and a (+) indicator may be displayed at the right end of the area composed of the series of bars.

According to various embodiments of the present disclosure, in the processor, the front view may additionally show, below the first line, the angle between the end section of the bucket and the target surface, and the side view may additionally show, below the second line, the angle between the back face of the bucket and the side target surface.

According to various embodiments of the present disclosure, the processor may additionally include, in the guidance screen, areas displaying the angle between the end section of the bucket and the target surface, the angle between the back face of the bucket and the side target surface, the horizontal travel distance from the reference point position to the current bucket position, the target depth value set based on the reference point position, the target tilt value viewed from the front, and the target tilt value viewed from the side. The processor may display the areas on the display device.

According to various embodiments of the present disclosure, the processor may additionally include, in the guidance screen, areas displaying the reference point set button for setting the current bucket position as the reference point position, and the reference point set method button for setting the reference point set method. The processor may display the areas on the display device.

As described above, the machine guidance program provided in the excavator according to the embodiment of the present disclosure intuitively present the operator with the operation directions required for the end horizontal alignment and back face horizontal alignment between the bucket and the target surface, so that even unskilled workers can easily perform the horizontal alignment, and thus, the work efficiency of the construction machine can be increased.

The machine guidance program, the guidance screen or user interface (UI) of the excavator 300 according to the embodiments of the present disclosure may be implemented with instructions that can be executed by a processor (e.g., the processor 310), and may be stored in a computer-readable storage medium. The processor reads and executes the corresponding instructions from the storage medium, so that the UI or the guidance screen can display on the display device.

Directly and/or indirectly and regardless of whether the storage media is in a raw state, in a formatted state, an organized state, or in any other accessible state, the storage media may include a relational database, a non-relational database, an in-memory database, and a database which can store a data and include a distributed type database, such as other suitable databases that allows access to the data through a storage controller. In addition, the storage medium includes a primary storage device, a secondary storage device, a tertiary storage device, an offline storage device, a volatile storage device, a nonvolatile storage device, a semiconductor storage device, a magnetic storage device, an optical storage device, and a flash storage device, a hard disk drive storage device, a floppy disk drive, a magnetic tape, or any type of storage device such as other suitable data storage medium.

Although the present invention has been described with reference to the embodiment shown in the drawings, this is just an example and it will be understood by those skilled in the art that various modifications and equivalent thereto may be made. Therefore, the true technical scope of the present invention should be determined by the spirit of the appended claims.

What is claimed is:

1. A machine guidance apparatus which assists an operator of an excavator comprising a bucket to operate, the machine guidance apparatus configured to display a guidance screen on a display device, wherein the guidance screen comprises:

a front view which comprises a first icon indicating a front shape of the bucket and a first line indicating a target surface of a design drawing, and visually indicates a degree of alignment between an end section of the bucket and the target surface;

a first guide indicator which guides in which tilting direction the operator should operate;

a side view which comprises a second icon indicating a side shape comprising a back face of the bucket and a second line indicating a side target surface of the design drawing, and visually indicates a degree of alignment between the back face of the bucket and the side target surface; and a second guide indicator which guides whether the operator should operate in a dump direction or in a crowd direction, wherein each of the first guide indicator and the second guide indicator comprises a series of bars and a ball shape which are positioned between a left end and a right end on the series of bars.

2. The machine guidance apparatus of claim 1, wherein a length of the series of bars gradually increases toward the left or right from a center of the guide indicator.

3. The machine guidance apparatus of claim 2, wherein, when a horizontal alignment is made between the end section of the bucket and the target surface of the design drawing, the ball shape of the first guide indicator is displayed positioned at the center of the series of bars, wherein, when the horizontal alignment is not made between the end section of the bucket and the target surface of the design drawing and the bucket needs to be tilted in a (−) tilting direction for the horizontal alignment, the ball shape of the first guide indicator is displayed positioned on the left from the center of the series of bars, and wherein, when the horizontal alignment is not made between the end section of the bucket and the target surface of the design drawing and the bucket needs to be tilted in a (+) tilting direction for the horizontal alignment, the ball shape of the first guide indicator is displayed positioned on the right from the center of the series of bars.

4. The machine guidance apparatus of claim 3, wherein, when the horizontal alignment is made between the back face of the bucket and the side target surface of the design drawing, the ball shape of the second guide indicator is displayed positioned at the center of the series of bars, wherein, when the horizontal alignment is not made between the back face of the bucket and the side target surface of the design drawing and the bucket needs to be tilted in the crowd direction for the horizontal alignment, the ball shape of the second guide indicator is displayed positioned on the left from the center of the series of bars, and wherein, when the horizontal alignment is not made between the back face of the bucket and the side target surface of the design drawing and the bucket needs to be tilted in the dump direction for the horizontal alignment, the ball shape of the second guide indicator is displayed positioned on the right from the center of the series of bars.

5. The machine guidance apparatus of claim 2, wherein, when the horizontal alignment is made between the end section of the bucket and the target surface of the design drawing, the series of bars of the first guide indicator are represented in a first color, and wherein, when the horizontal alignment is not made between the end section of the bucket and the target surface of the design drawing, the series of bars of the first guide indicator are represented in a second color different from the first color.

6. The machine guidance apparatus of claim 4, wherein, when the horizontal alignment is made between the back face of the bucket and the side target surface of the design drawing, the series of bars of the second guide indicator are represented in a first color, and wherein, when the horizontal alignment is not made between the back face of the bucket and the side target surface of the design drawing, the series of bars of the second guide indicator are represented in a second color different from the first color.

7. The machine guidance apparatus of claim 2, wherein, in each of the first guide indicator and the second guide indicator, a (−) indicator is displayed at the left end of an area composed of the series of bars, and a (+) indicator is displayed at the right end of the area composed of the series of bars.

8. The machine guidance apparatus of claim 1, wherein the front view additionally shows, below the first line, an angle between the end section of the bucket and the target surface, and wherein the side view additionally shows, below the second line, an angle between the back face of the bucket and the side target surface.

9. The machine guidance apparatus of claim 1, wherein the guidance screen additionally comprises an angle between the end section of the bucket and the target surface, an angle between the back face of the bucket and the side target surface, a horizontal travel distance from a reference point position to a current bucket position, a target depth value set based on the reference point position, a target tilt value viewed from the front, and a target tilt value viewed from the side.

10. The machine guidance apparatus of claim 9, wherein the guidance screen additionally comprises a reference point set button for setting the current bucket position as the reference point position, and a reference point set method button for setting the reference point set method.

11. An excavator comprising:

a sensor device comprising an angle sensor of a pivot portion which connects a bucket and an upper body;

a storage device in which a machine guidance program assisting an operator of the excavator when the operator controls a position of the bucket has been recorded;

a display device; and a processor which executes the machine guidance program and displays a guidance screen on the display device, wherein the guidance screen comprises:

a front view which comprises a first icon indicating a front shape of the bucket and a first line indicating a target surface of a design drawing, and visually indicates a degree of alignment between an end section of the bucket and the target surface;

a first guide indicator which guides in which tilting direction the operator should operate;

a side view which comprises a second icon indicating a side shape comprising a back face of the bucket and a second line indicating a side target surface of the design drawing, and visually indicates a degree of alignment between the back face of the bucket and the side target surface; and a second guide indicator which guides whether the operator should operate in a dump direction or in a crowd direction, wherein each of the first guide indicator and the second guide indicator comprises a series of bars and a ball shape which are positioned between a left end and a right end on the series of bars.

12. The excavator of claim 11, wherein a length of the series of bars gradually increases toward the left or right from a center of the guide indicator.

13. The excavator of claim 12, wherein, by the processor, when a horizontal alignment is made between the end section of the bucket and the target surface of the design drawing, the ball shape of the first guide indicator is displayed positioned at the center of the series of bars, wherein, by the processor, when the horizontal alignment is not made between the end section of the bucket and the target surface of the design drawing and the bucket needs to be tilted in a (−) tilting direction for the horizontal alignment, the ball shape of the first guide indicator is displayed positioned on the left from the center of the series of bars, and wherein, by the processor, when the horizontal alignment is not made between the end section of the bucket and the target surface of the design drawing and the bucket needs to be tilted in a (+) tilting direction for the horizontal alignment, the ball shape of the first guide indicator is displayed positioned on the right from the center of the series of bars.

14. The excavator of claim 13, wherein, by the processor, when the horizontal alignment is made between the back face of the bucket and the side target surface of the design drawing, the ball shape of the second guide indicator is displayed positioned at the center of the series of bars, wherein, by the processor, when the horizontal alignment is not made between the back face of the bucket and the side target surface of the design drawing and the bucket needs to be tilted in the crowd direction for the horizontal alignment, the ball shape of the second guide indicator is displayed positioned on the left from the center of the series of bars, and wherein, by the processor, when the horizontal alignment is not made between the back face of the bucket and the side target surface of the design drawing and the bucket needs to be tilted in the dump direction for the horizontal alignment, the ball shape of the second guide indicator is displayed positioned on the right from the center of the series of bars.

15. The excavator of claim 12, wherein, by the processor, when the horizontal alignment is made between the end section of the bucket and the target surface of the design drawing, the series of bars of the first guide indicator are represented in a first color, and wherein, by the processor, when the horizontal alignment is not made between the end section of the bucket and the target surface of the design drawing, the series of bars of the first guide indicator are represented in a second color different from the first color.

16. The excavator of claim 14, wherein, by the processor, when the horizontal alignment is made between the back face of the bucket and the side target surface of the design drawing, the series of bars of the second guide indicator are represented in a first color, and wherein, by the processor, when the horizontal alignment is not made between the back face of the bucket and the side target surface of the design drawing, the series of bars of the second guide indicator are represented in a second color different from the first color.

17. The excavator of claim 12, wherein, by the processor, in each of the first guide indicator and the second guide indicator, a (−) indicator is displayed at the left end of an area composed of the series of bars, and a (+) indicator is displayed at the right end of the area composed of the series of bars.

18. The excavator of claim 11, wherein, by the processor, the front view additionally shows, below the first line, an angle between the end section of the bucket and the target surface, and wherein, by the processor, the side view additionally shows, below the second line, an angle between the back face of the bucket and the side target surface.

19. The excavator of claim 11, wherein the processor additionally comprises, in the guidance screen, areas displaying an angle between the end section of the bucket and the target surface, an angle between the back face of the bucket and the side target surface, a horizontal travel distance from a reference point position to a current bucket position, a target depth value set based on the reference point position, a target tilt value viewed from the front, and a target tilt value viewed from the side, and displays them on the display device.

20. The excavator of claim 19, wherein the processor additionally comprises, in the guidance screen, areas displaying a reference point set button for setting the current bucket position as the reference point position, and a reference point set method button for setting the reference point set method, and displays them on the display device.

* * * * *